US008697008B2

(12) United States Patent
Clarke et al.

(10) Patent No.: US 8,697,008 B2
(45) **Date of Patent: *Apr. 15, 2014**

(54) DROPLET GENERATOR

(75) Inventors: Andrew Clarke, Haslingfield (GB); Nicholas J. Dartnell, Longstanton (GB); Christopher B. Rider, Hardwick (GB)

(73) Assignee: Eastman Kodak Company, Rochester, NY (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/257,373

(22) PCT Filed: Mar. 9, 2010

(86) PCT No.: PCT/US2010/000703

§ 371 (c)(1),
(2), (4) Date: Nov. 16, 2011

(87) PCT Pub. No.: WO2010/110843

PCT Pub. Date: Sep. 30, 2010

(65) Prior Publication Data

US 2012/0048882 A1 Mar. 1, 2012

(30) Foreign Application Priority Data

Mar. 25, 2009 (GB) ..... 0905050.1
Jun. 30, 2009 (GB) ..... 0911316.8

(51) Int. Cl.
*B01L 3/00* (2006.01)

(52) U.S. Cl.
CPC ... *B01L 3/502715* (2013.01); *B01L 2300/0861* (2013.01); *Y10S 435/808* (2013.01); *Y10S 436/805* (2013.01); *Y10S 436/809* (2013.01)
USPC ..... 422/502; 422/52; 422/82.05; 422/82.06; 422/82.07; 422/82.08; 422/82.09; 422/82.11; 422/407; 422/500; 422/501; 422/503; 422/504; 422/930; 435/164; 435/165; 435/283.1; 435/287.1; 435/288.7; 435/808; 435/4; 435/5; 435/7.2; 435/7.9; 436/52; 436/53; 436/164; 436/165; 436/172; 436/174; 436/518; 436/524; 436/525; 436/526; 436/805; 436/809; 204/403.01; 204/409; 506/3; 506/39; 359/321; 250/458.1; 250/559.29; 250/574; 356/128; 356/244; 356/246; 356/300; 356/326; 356/414; 356/416; 356/445; 430/290; 430/321; 347/73; 347/74; 347/75

(58) Field of Classification Search
CPC ..... B01L 2300/0816
USPC ..... 422/502, 930, 52, 82.05, 82.06, 82.07, 422/82.08, 82.09, 82.11, 407, 500, 501, 422/503, 504; 347/73, 74, 75; 435/164, 435/165, 283.1, 287.1, 287.2, 288.7, 808, 4, 435/5, 7.2, 7.9; 436/52, 53, 164, 165, 172, 436/174, 518, 524, 525, 526, 805, 809; 204/403.01, 409; 506/3, 39; 359/321; 250/458.1, 559.29, 574; 430/290, 321; 356/128, 244, 246, 300, 326, 414, 416, 356/445
See application file for complete search history.

(56) References Cited

U.S. PATENT DOCUMENTS

2005/0161326 A1 7/2005 Morita et al.
2005/0172476 A1 8/2005 Stone et al.
2008/0044884 A1 2/2008 Hwang et al.

FOREIGN PATENT DOCUMENTS

WO WO 2006/022487 3/2006

(Continued)

OTHER PUBLICATIONS

Bhagat et al , "A passive planar micromixer with obstructions for mixing at low Reynolds numbers", J. Micromech. Microeng. 17, p. 1017-1024, published Apr. 17, 2007.*

(Continued)

*Primary Examiner* — Dennis M White
(74) *Attorney, Agent, or Firm* — William R. Zimmerli

(57) ABSTRACT
A method and device for periodically perturbing the flow field within a microfluidic device to provide regular droplet formation at high speed.

20 Claims, 3 Drawing Sheets

(56) References Cited

FOREIGN PATENT DOCUMENTS

| | | |
|---|---|---|
| WO | WO 2009/004312 | 1/2009 |
| WO | WO 2009/004314 | 1/2009 |
| WO | WO 2009/004318 | 1/2009 |

OTHER PUBLICATIONS

Bearman, "Vortex shedding from oscillating bluff bodies", Ann. Rev. Fluid Mech. 1984, pp. 195-222.*

Thorsen, T. et al., "Dynamic Pattern Formation in a Vesicle-Generating Microfluidic Device," *Physical Review Letters*, 86, 4163 (2001).

Utada, A.S. et al., "Dripping, Jetting, Drops, and Wetting: The Magic of Microfluidics," *MRS Bulletin*, vol. 32, pp. 702-708 (2007).

Anna, S. L. et al., "Formation of Dispersions Using 'Flow Focusing' in Microchannels," *Applied Physics Letters*, 82, 364 (2003).

Guillot, P. et al., "Stability of a Jet in Confined Pressure-Driven Biphasic Flows at Low Reynolds Numbers," *Physical Review Letters*, 99, 104502 (2007).

Utada, A. S. et al., "Dripping to Jetting Transitions in Coflowing Liquid Streams," *Physical Review Letters*, 99, 094502 (2007).

Stone, H. A. et al., "Engineering Flows in Small Devices: Microfluidics Toward a Lab-on-a-Chip", *Annual Review of Fluid Mechanics*, vol. 36, pp. 381-411 (2004).

* cited by examiner

DROPLET GENERATOR

FIELD OF THE INVENTION

This invention relates to the field of microfluidic devices. More particularly the invention relates to an apparatus and method of forming droplets of a first liquid within a second carrier liquid.

BACKGROUND OF THE INVENTION

In recent years there has been an explosion of work demonstrating the formation of oil in water or water in oil droplets within microfluidic devices. The interest was initiated by pioneering work of the groups of Quake, (T Thorsen, R W Roberts, F H Arnold, and S R Quake, PRL 86, 4163 (2001)), Weitz (A S Utada, L-Y Chu, A Fernadez-Nieves, D R Link, C Holtze, and D A Weitz, MRS Bulletin 32, 702 (2007)) and Stone (S L Anna, N Bontoux, and H A Stone, Appl. Phys. Lett. 82, 364 (2003)), these papers both elucidating the behaviour of concentric multiphase flows and demonstrating exquisite control over synthesis of multiphase droplet systems. In all cases the fundamental microfluidic component is a flow focussing arrangement that brings together two immiscible phases. Cascading such components has enabled water-in-oil-in-water-in-oil etc. systems to be created. Further, such microfluidic devices may be used as a general fabrication route to precisely control monodisperse materials, although such elemental devices would need to be fabricated massively in parallel in order that useful quantities of material may be made. Planar flow focussing devices have the utility of easy fabrication through the now well known PDMS fabrication process. Since PDMS is an intrinsically hydrophobic material it has been readily utilised to make water-in-oil systems that have been the particular focus for biological investigation where each droplet can be used as a reactor, for example for PCR reactions.

The particular interest in these microfluidic flow focussing systems stems from their ability to form precise monodisperse droplets, usually at rates up to a few kHz. Several papers have demonstrated that the formation of monodisperse droplets is the result of a flow instability associated with the two phase flow within a nozzle. Guillot et al (P Guillot, A Colin, A S Utada, and A Ajdari, PRL 99, 104502 (2007)) have shown that the flow instabilities associated with multiphase flow in such a flow focussing device can be described as either absolutely unstable, i.e. a dripping mode, or convectively unstable, i.e. a jetting mode. The jetting mode is a generalisation of the well known Rayleigh-Plateau instability of a free jet. A jet of one liquid within another will disintegrate into a series of droplets with a well defined average wavelength and therefore size irrespective of the flow rate. However in contrast to the flow focussing dripping mode the droplets will in general be polydisperse. In order to form monodisperse drops either the dripping or the geometry controlled drop formation mode is required. Utada (A S Utada, A Fernandez-Nieves, H A Stone, and D A Weitz, PRL 99, 094502 (2007)) has demonstrated that these modes are constrained to finite Capilliary and Weber number (Ca, We), that is the region where the growth of a perturbation propagates both upstream and downstream and is therefore absolutely unstable.

In order to take the exquisite control of droplet formation and synthesis afforded by microfluidic systems to a practical drop fabrication methodology, the ability to generate monodisperse droplets at significantly higher frequency is required. Further such methods then also become potentially useful as droplet generators for continuous inkjet.

WO2009/004314 and WO2009/004312 are examples of droplet formation in microfluidic devices.

Flow focusing devices are now well known in the art, for example see US2005/0172476. In these devices a first fluid phase that will become droplets is introduced via a middle channel and a second fluid phase that will become the surrounding carrier phase is introduced via at least two separated and symmetrically placed channels either side of the middle channel. Provided the walls of the channels supplying the carrier phase and the outlet channel are preferentially wetted by the carrier phase it will completely surround the first fluid phase which then breaks into droplets, i.e. the droplet phase.

In the prior art a common occurrence of obstructions in the context of a microfluidic device is by way of an array of pillars, in some instances activated or with a surface coating that are used as an in-line filter or collection device, see for example US2008/0044884. These pillars are not intended to cause significant turbulence to the bulk flow and the device is intended for a single fluid flow. US2005/0161326 discloses in one embodiment an array of pillars in the flow channel slightly downstream of the intersection of the flow of two separate fluids. The pillars are deliberately added to cause non-laminar flow to aid the mixing of the two fluids to promote chemical reaction between the components, the two fluids being therefore miscible. WO2006/022487 also discloses an array of pillars in a flow channel but as a means of accelerating flow in the channel through an increase of the capillary force on the fluid. This usage is to quantitatively regulate the flow of a single fluid in a microfluidic device used for analytic or diagnostic purposes.

Problem to be Solved by the Invention

All prior microfluidic multiphase drop generation devices that produce monodisperse drops of an internal phase within a carrier phase operate at low frequencies. That is their frequency is limited by the necessity to keep the system in an absolutely unstable, i.e. dripping, regime. This therefore severely limits the rate of production of droplets. The invention solves this problem by enabling monodisperse droplet formation from a high speed multiphase jet.

SUMMARY OF THE INVENTION

Regular drop breakup has been obtained by inducing periodic perturbations to the inlet flow of a device. In this case a passive perturbation is achieved by placing an obstruction or pillar in the inlet flow. Above a critical Reynolds number unstable vortices are generated and above a higher critical Reynolds number vortices are periodically shed. This latter is referred to as von Karman vortex shedding. Either unstable vortices or shed vortices periodically perturb the internal immiscible jet and initiate jet breakup.

According to the present invention there is provided a microfluidic device for forming droplets of a droplet fluid phase within a carrier fluid phase, the device comprising a plurality of inlet channels, at least one for at least part of the droplet fluid phase and at least one for at least part of the carrier fluid phase, and at least one outlet channel, at least one of the inlet channels being provided with internal means for periodically perturbing the inlet flow at the confluence of the said phases.

The invention further provides a method of forming droplets of a droplet fluid phase, from a jet of droplet fluid phase, within a carrier fluid phase, the flow of one or both of the droplet fluid phase and the carrier fluid phase being periodically perturbed by a flow instability.

Advantageous Effect of the Invention

This invention enables monodisperse droplet formation from a high speed multiphase jet at very high flow rates within.

BRIEF DESCRIPTION OF THE DRAWINGS

The invention will now be described with reference to the accompanying drawings in which.

DETAILED DESCRIPTION OF THE INVENTION

Figure 1:
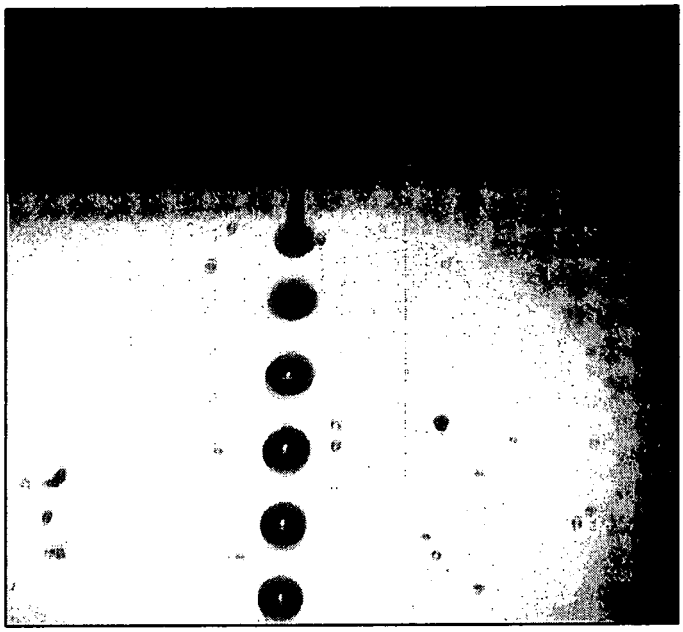
FIG. 1 shows regular water jet breakup from a T-piece device.

A Karman vortex street is a repeating pattern of swirling vortices caused by the unsteady separation of flow around a bluff body in a fluid flow. This process is responsible for such phenomena as the singing of telephone wires, the fluttering of flags etc. A vortex street will only be observed for flows above a critical Reynolds number ($Re=\rho Ud/\eta$; $\rho$ the density in $kg/m^3$, U the fluid velocity in m/s, d the diameter of the bluff body in m, and $\eta$ the fluid viscosity in Pa·s). The range of Reynolds number over which vortices are shed will vary depending on the kinematic viscosity and shape of the bluff body, but is typically $47<Re<10^7$. As vortices are shed then an alternating transverse force is experienced by the bluff body. If the body can deform or move and the frequency of shedding is comparable to the natural frequency of the body, then resonance can ensue.

Typically vortex shedding and the induced resonance are detrimental and many inventions exist to suppress this phenomenon, particularly for suspended cables and towers.

The frequency of vortex shedding for a long circular cylinder is given by the empirical formula:

$$\frac{fd}{U} = 0.198\left(1 - \frac{19.7}{\mathrm{Re}}\right)$$

with f the frequency in Hz. This formula is typically valid for Re>250.

At lower Reynolds number vortices will exist downstream of the bluff body and can set the body into resonance even without shedding vortices. Further, in a confined flow, such oscillations between flow to one side or the other of the bluff body can occur and will again have a natural frequency depending on the flow rate and size of the bluff body.

Such flow instabilities naturally affect the flow of other liquid streams further downstream of the bluff body. At greater distances downstream, the viscosity of the liquid streams will dissipate energy and the flow fluctuations will decay away. The rate of decay depends on the viscosity, flow velocity and channel width, which is the smallest dimension of the channel. This distance is usually termed the entrance length for developed flow and is given approximately for laminar flow as $$\frac{L}{D} = 0.06\mathrm{Re} = 0.06\frac{\rho UD}{\eta}$$

with L the entrance length (m), D the channel width (m), Re the Reynolds number, r the density ($kg/m^3$), U the flow velocity (m/s) and h the liquid viscosity (Pa·s). For turbulent flow the approximation becomes, $$\frac{L}{D} = 4.4\mathrm{Re}^{1/6} = 4.4\left(\frac{\rho UD}{\eta}\right)^{1/6}$$

We are interested in laminar flow, however, vortex shedding (above Re≈47) is a partially turbulent flow in this context. Whilst the optimal position of the bluff body will depend on these variables it will be expected by one skilled in the art that the bluff body's position should therefore be less than about fifteen and preferably less than ten channel widths and more preferably less than five channel widths from the location where the flow fluctuations are desired to have an effect.

The internal bluff body may extend partially into the flow, or cross a flow channel allowing liquid to pass either side. Such a body may be hard or may be deformable, it may be passive such as, but not restricted to, a polymeric rod. Alternatively it may be active such as, but not restricted to, a bimetallic strip or a heated wire or rod. Other methods known in the art of additionally perturbing the inlet flow may be used in conjunction with the bluff body such as but not limited to heaters, see WO2009/004318, electrophoresis, dielectrophoresis, electrowetting (also known as electrocapillarity), piezo electric elements (see e.g. "ENGINEERING FLOWS IN SMALL DEVICES: Microfluidics Toward a Lab-on-a-Chip", H. A. Stone, A. D. Stroock, and A. Ajdari, Annu. Rev. Fluid Mech. 2004. 36:381-411). These methods can also be used in the absence of the bluff body.

FIG. 1 shows a water jet breakup from a T-piece device. It was noticed that when pumping deionised water through both channels of the T piece with nozzle at a certain pressure and pressure ratio, very regular jet breakup occurred. This was unexpected.

On consideration of the flows, it seems likely that the arm of the T piece was regularly shedding vortices which perturbed the nozzle flow initiating Rayleigh breakup. A calculation, using a rod as a von Karmen street generator, was subsequently made using Comsol Multiphysics, a commercial finite element modeling software.

It is clear that the Von Karmen street of vortices can interact with the nozzle to perturb the jet flow sufficiently to create regular droplets. This will be a rather general mechanism to create a droplet generator for, for example, continuous inkjet or other systems requiring jet breakup (e.g. flow cytometry) or particle manufacture. A variety of ways can be conceived of creating vortex streets within such a microfluidic device. However the Re number will likely have to be greater than a threshold of order 40. This is commensurate with continuous jet formation from a small orifice.

In order to demonstrate the principle of vortex perturbation of a jet leading to droplet formation a pair of microfluidic flow focussing devices were prepared; one with pillars, one without.

Figure 2:
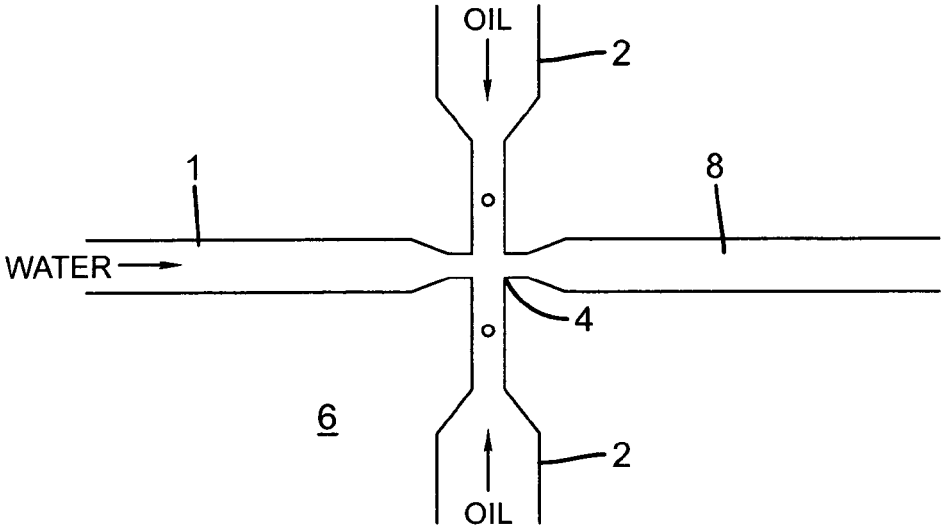
FIG. 2 is a schematic drawing of an embodiment of the invention.

FIG. 2 is a schematic view of a device according to the invention.

The device shown has an inlet channel 1 for a first fluid phase. Two outer inlet channels, 2 are provided for a second fluid phase. The inlet channels 2 meet the inlet channel 1 at a junction 4. Internal obstructions or pillars 6 are provided within the inlet channels 2. An outlet channel 8 is provided downstream of the junction 4. The embodiment illustrated shows the junction as a flow focussing device.

The first fluid phase, the droplet fluid phase, may be water. The second fluid phase, the carrier fluid phase, may be an oil such as hexadecane. Either or both of these fluid phases may contain one or more of particulates, dispersant, surfactant, polymer, oligomer, monomer, solvent, biocide, salt, cross-linking agent, precipitation agent.

A device such as that shown in FIG. 2 was constructed in PDMS and tested for flows of water against hexadecane as the oil phase. A similar device but without the pillars 6 in the outer inlet flow channels 2 was also constructed and tested. The fluid flows are driven by pressure and so for low pressure and therefore low flow velocities and lower Reynolds number the expected dripping regime was observed for devices both with and without pillars.

Figure 3:
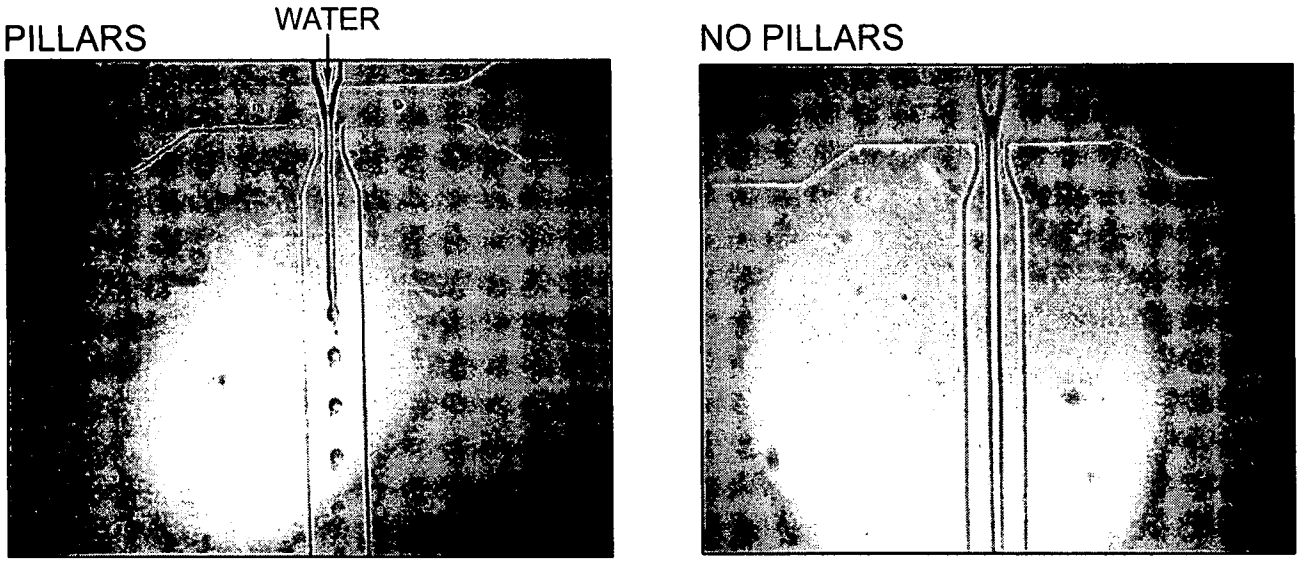
FIG. 3 shows images of monodisperse water in oil drop formation with pillars compared with an unbroken thread for the device without pillars.

As the pressure of both fluids is increased the dripping mode transitions to a jetting mode for both devices and images can be recorded for an extended thread of water breaking into drops. However these are not particularly monodisperse in size. By increasing the oil and water pressure further a threshold condition is passed as the fluid velocities and therefore Reynolds number for the flow increases. Above this threshold condition the vortex perturbations from flow passing the pillars causes the break-up of the water thread in a regular fashion giving high frequency monodisperse drops of water in oil. These vortex perturbations create unsteady but periodic eddies. For the device without pillars 6 under the same conditions it is only possible to generate a stable unbroken thread of water in oil that persists over the full 5 mm distance between the flow focussing region and exit port. This is shown in FIG. 3.

It was noted that the pillars 6 are able to oscillate as the flow passed. The material used for the device is not critical. However it is necessary that the inner surface of the channels 2 and the outlet channel 8 are preferentially wetted by the carrier fluid otherwise either the thread of the droplet phase or the droplets or both will adhere to a channel wall.

A calculation was performed to model the flow in the device as described above. At low flow rates although vortices exist downstream of each pillar, there is no instability. However, above a critical flow rate, an oscillation appears, even with a single phase.

In the embodiment illustrated in FIG. 2 the pillars are located in the inlet channels 2. The invention is not limited to this embodiment. The pillars may be provided in inlet channel 1. It is also possible for all inlet channels to be provided with pillars. Equally there may be only one inlet channel 2. To further disturb the flow within the channels, for example to phase lock the droplet formation, a heating element, or electrodes for electrophoresis or dielectrophoresis or electroosmosis may be located adjacent any of the carrier fluid channels 2.

It will be obvious to one skilled in the art that the first and second immiscible phases can be reversed provided the wettability of the internal surfaces of the microfluidic channels is also reversed i.e. made to be preferentially wet by the carrier phase instead.

Figure 4:
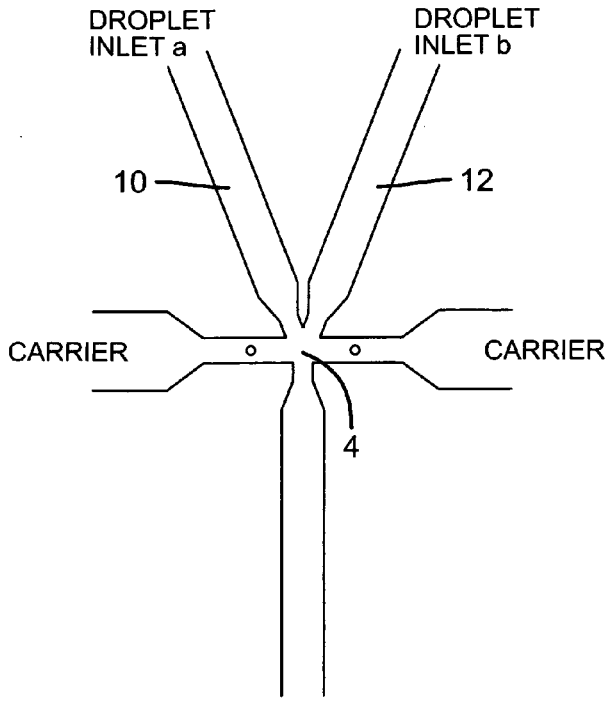
FIG. 4 is a schematic drawing of another embodiment of the invention.
Figure 5:
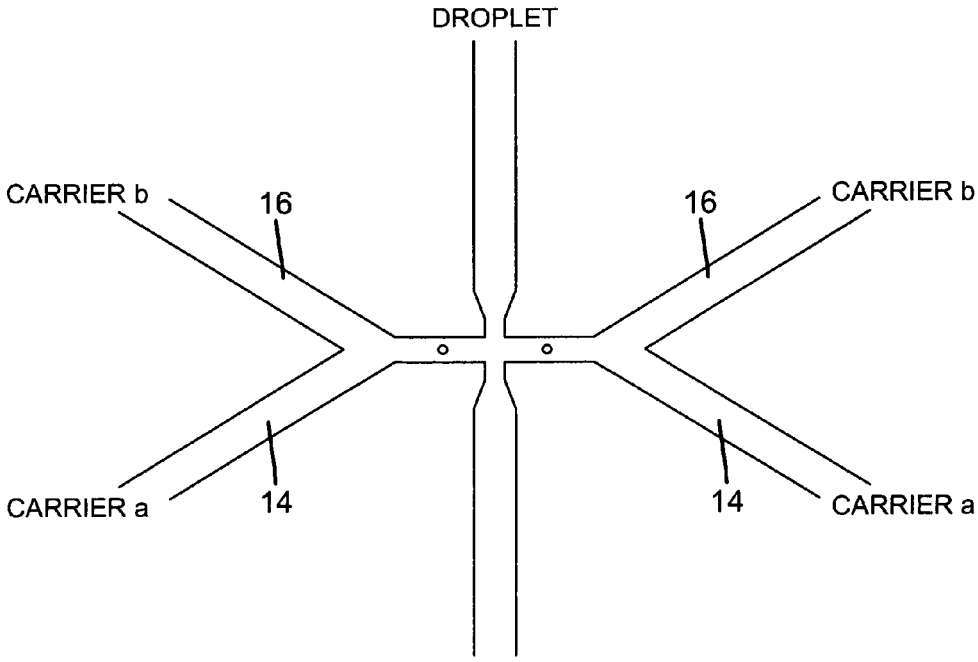
FIG. 5 is a schematic drawing of a further embodiment of the invention.

The device as described may be extended to create more complex multiphase droplets by providing additional liquids via additional inlet channels. Each additional inlet may comprise either the same or additional fluid phases and each fluid phase may additionally contain one or more of particulates, dispersant, surfactant, polymer, oligomer, monomer, solvent, biocide, salt, cross-linking agent, precipitation agent. An example of a more complex drop would be a Janus droplet whereby the droplet phase is supplied as two parts, 10, 12, via two channels that meet at or prior to the junction 4 with the carrier fluid channel. Such an arrangement is shown in FIG. 4. The droplet phase supplied in the two channels may contain differing additional components. A further example of an arrangement to generate a more complex drop would be that required to generate a core-shell system. Such an arrangement is shown in FIG. 5. Here the carrier phase is supplied as two parts 14, 16: a first part 14 that contacts the droplet phase and a second part 16 that does not contact the droplet phase but from which a component may diffuse to the droplet phase and which causes at least the outer part of the droplet phase to precipitate or cross link thereby encasing the droplet phase. These are examples of more complex arrangements and do not limit the scope of the invention.

Devices such as that shown in FIG. 2 may be cascaded, i.e. placed in series on a microfluidic chip to create a more complex droplet or may be connected in parallel to create droplets at a higher integrated rate. Further the devices may be advantageously combined with other microfluidic elements, e.g. mixers, sorters, concentrators, diluters, UV curers etc. to create specifically designed materials.

It is shown that introduction of bluff bodies, pillars in this case, into the inlet flow cause flow oscillations that in turn cause very regular perturbations to the liquid thread. These perturbations of the liquid thread initiate a Rayleigh-Plateau instability in turn causing the thread to break very regularly. Such regularity enables monodisperse droplets to be manufactured at very high speeds.

The invention claimed is:

1. A microfluidic device for forming droplets of a droplet fluid phase within a carrier fluid phase, the device comprising a plurality of inlet channels, at least one for at least part of the droplet fluid phase and at least one for at least part of the carrier fluid phase, and at least one outlet channel, at least one of the inlet channels being provided with internal means for periodically perturbing the inlet flow at the confluence of the said phases, the internal means for periodically perturbing the inlet flow at the confluence of the said phases including a bluff body located in the at least one of the inlet channel, wherein fluid phase flow around the bluff body causes a passive periodic perturbation of the inlet flow at the confluence of the phases.

2. A device as claimed in claim 1 wherein a flow focussing device brings together the said fluid phases.

3. A device as claimed in claim 1 wherein one of the droplet fluid phase or the carrier fluid phase has a water component.

4. A device as claimed in claim 1 wherein any of said fluid phases contain one of more of particulates, dispersant, surfactant, polymer, oligomer, monomer, solvent, biocide, salt, cross-linking agent, precipitation agent.

5. A device as claimed in claim 1 including one of a heating element, an electrode for electrophoresis or dielectrophoresis, a pair of electrodes for electro-osmosis adjacent an inlet channel to periodically perturb the flow of the carrier fluid phase therein.

6. A device as claimed in claim 1 wherein the internal means for perturbing the flow oscillates in response to the flow.

7. A device as claimed in claim 1, the at least one the inlet channel that is provided with said internal means for periodically perturbing the inlet flow at the confluence of said phases having a channel width, wherein said internal means for periodically perturbing the inlet flow at the confluence of said phases is less than fifteen channel widths from the confluence of said phases.

8. A device to form droplets of a droplet fluid phase within a carrier fluid phase comprising a plurality of devices as claimed in claim 1.

9. A device as claimed in claim 1 wherein the droplet fluid phase and the carrier fluid phase are immiscible relative to each other.

10. A device as claimed in claim 1, the at least one the inlet channel that is provided with said internal means for periodically perturbing the inlet flow at the confluence of said phases having a channel width, wherein said internal means for periodically perturbing the inlet flow at the confluence of said phases is less than ten channel widths from the confluence of said phases.

11. A device as claimed in claim 1, the at least one the inlet channel that is provided with said internal means for periodically perturbing the inlet flow at the confluence of said phases having a channel width, wherein said internal means for periodically perturbing the inlet flow at the confluence of said phases is less than five channel widths from the confluence of said phases.

12. A method of forming droplets of a droplet fluid phase, from a jet of droplet fluid phase, within a carrier fluid phase, within a microfluidic device including a plurality of inlet channels leading to a confluence of said phases, the flow of one or both of the droplet fluid phase and the carrier fluid phase being passively periodically perturbed by a flow instability caused by a bluff body flow obstruction located within at least one of the inlet channels provided for at least part of the droplet fluid phase or for at least part of the carrier fluid phase.

13. A method as claimed in claim 12 wherein the flow instability is caused by a flow obstruction within at least one inlet channel, at least one inlet channel being provided for at least part of the droplet fluid phase and at least one inlet channel for at least part of the carrier fluid phase.

14. A method as claimed in claim 12 wherein vortex perturbations from the flow passing by said internal means for periodically perturbing the inlet flow at the confluence of the said phases causes the flow to be disturbed by one or more unsteady eddies.

15. A method as claimed in claim 12 wherein the Reynolds number of the flow of the carrier fluid phase is greater than 10.

16. A method as claimed in claim 12 wherein the flow of the carrier phase flow is additionally periodically perturbed by one of a heating element, an electrode for electrophoresis or dielectrophoresis, a pair of electrodes for electro-osmosis adjacent an inlet channel.

17. A method as claimed in claim 12, the at least one the inlet channel that is provided with said internal means for periodically perturbing the inlet flow at the confluence of said phases having a channel width, wherein said internal means for periodically perturbing the inlet flow at the confluence of said phases is less than fifteen channel widths from the confluence of said phases.

18. A method as claimed in claim 12 wherein said formed droplets are substantially monodisperse.

19. A method as claimed in claim 12 wherein the Reynolds number of the flow of the carrier fluid phase is greater than 40.

20. A method as claimed in claim 12 wherein the droplet fluid phase and the carrier fluid phase are immiscible relative to each other.

* * * * *